US006908067B2

(12) United States Patent
Clasen

(10) Patent No.: US 6,908,067 B2
(45) Date of Patent: Jun. 21, 2005

(54) GROUND ANCHORING SUNSHADE UMBRELLA STAND

(76) Inventor: Reinhard Herman Clasen, 930 W. Belleview Ave., Porterville, CA (US) 93257

( * ) Notice: Subject to any disclaimer, the term of this patent is extended or adjusted under 35 U.S.C. 154(b) by 80 days.

(21) Appl. No.: 10/266,520

(22) Filed: Oct. 7, 2002

(65) Prior Publication Data

US 2004/0065802 A1 Apr. 8, 2004

(51) Int. Cl.[7] ..... A01K 97/10
(52) U.S. Cl. ..... 248/533; 248/545
(58) Field of Search ..... 248/161, 158, 248/530, 532, 533, 156, 370, 545, 121, 188.9; 52/156, 165, 298, 297, 188.9; 135/44, 16, 80, 15.1; D21/840; D30/154; D8/387

(56) References Cited

U.S. PATENT DOCUMENTS 292,129 A * 1/1884 Moore
930,607 A * 8/1909 Morrill ..... 52/165
2,633,317 A * 3/1953 Marsh
3,304,035 A * 2/1967 Davis
3,827,571 A * 8/1974 Koutny ..... 211/59.1
4,453,640 A * 6/1984 Cillario ..... 211/133.4
4,567,907 A * 2/1986 Dubinsky ..... 132/20 M
4,832,304 A * 5/1989 Morgulis ..... 248/533
4,850,564 A * 7/1989 Padin ..... 248/533
4,866,866 A * 9/1989 Rotter ..... 40/610
4,918,896 A * 4/1990 Wiese ..... 52/632
5,437,423 A * 8/1995 Sinclair ..... 248/96
D398,363 S * 9/1998 LoBue ..... D21/255
6,113,054 A * 9/2000 Ma ..... 248/523
6,467,233 B1 * 10/2002 Maliszewski ..... 52/720.1
6,487,977 B1 * 12/2002 Williams ..... 108/50.12
6,607,208 B2 * 8/2003 Dartland ..... 280/292

FOREIGN PATENT DOCUMENTS

FR 2754294 A1 * 10/1996
JP 08182522 * 8/1996

* cited by examiner

*Primary Examiner*—Gwendolyn Baxter

(57) ABSTRACT

This is a sunshade umbrella stand comprised of a hollow pole, a steel spike, and an umbrella holder. The stand itself is hollow with a foot pedal protruding out from the bottom portion of the stand which is attached to a hammer which slides up and down within the stand. The steel spike is attached to the bottom of the stand and the foot pedal hammer makes contact with the spike forcing the spike into the ground; thus, allowing the stand to be firmly anchored to the surface of the earth. The umbrella holder fits upon the top of the stand into which an umbrella with its post can be placed, so that the umbrella is held firmly in place. The sunshade umbrella stand will not allow an umbrella to tilt or fall due to wind or some other natural occurrence.

4 Claims, 2 Drawing Sheets

GROUND ANCHORING SUNSHADE UMBRELLA STAND

CROSS REFERENCE TO RELATED APPLICATIONS

"Not Applicable"

STATEMENT REGARDING FEDERALLY SPONSORED RESEARCH OR DEVELOPMENT

"Not Applicable"

REFERENCE TO SEQUENCE LISTING

"Not Applicable"

BACKGROUND OF INVENTION

1. Field of the Invention

The present invention relates to a stand which can be firmly anchored into the ground for means of supporting a sunshade umbrella or the like.

2. Description of the Prior Art.

Often a stand is needed which can be firmly placed into the ground onto which a sunshade umbrella can be mounted. However, most umbrella stands, even though, they have a rounded end or a pointed end cannot be thrust firmly enough into the ground to keep them from falling over. Often only a small hole is made in loose ground which is not deep enough to maintain the weight of an umbrella, and if the ground is not loose and is compacted then it is virtually impossible to thrust an umbrella stand into it.

U.S. Pat. No. 2,211,283 Mercer, U.S. Pat. No. 4,832,304 Morgulis, U.S. Pat. No. 5,152,495 Jacinto, describe umbrella stands where the bottom end is a drill and in the middle of the stand there is a handle with which the drill can be rotated and turned into the ground.

U.S. Pat. No. 5,156,369 Tizzoni, describes a hollow cylinder to which there is an umbrella attached where in the middle of the cylinder there is a shaft and the lower portion of the shaft is a drill. The other end of the shaft is attached to a handle and when the handle is turned it turns the shaft causing the drill to turn, screwing itself into the ground and anchoring the hollow cylinder upon the earth.

U.S. Pat. No. 5,749,386 Samuel Jr., describes a self-supporting golf umbrella stand with the bottom end being a spike which can be anchored into the ground by thrusting upon a pivotal foot pedal causing the spike to penetrate the ground.

U.S. Pat. No. 5,502,910 Lucchesi, describes a stand with a vertical pipe which has a spike on the bottom and can be thrust into the ground with a telescoping thrusting mechanism. Afterwards, the thrusting mechanism can be removed and a sign, such as real estate sign can be fixed on top of the stand.

U.S. Pat No. 4,524,533 Still, describes a pole with a disk mounted on the upper portion over which a pipe with a weight is placed to be used as a thrusting mechanism to force the stand securely into the ground. Once the stand is firmly anchored in the earth the thrusting pipe and weight can be removed and a sign can be fixed on top of the stand, such as a real estate sign.

U.S. Pat. No. 6,412,748 Girard, describes a stand with a spike on the bottom end and a fixed foot pedal protruding from the middle onto which can be thrust upon forcing the stand to penetrate the ground. A strapping mechanism can then be placed around the stand and a beach umbrella pole to hold the umbrella in place.

SUMMARY OF THE INVENTION

It is the prospect of this invention to provide a secure stand which can be thrust into the ground for a sunshade umbrella. This invention will also comprise a holder which will securely hold different variations of a sunshade umbrella post to the stand, and a pointed spike which can be removed from the stand when the stand is not in use and needs to be stored. The stand itself is comprised of two hollow pipes welded together at their ends and the bottom pipe having a larger diameter than the upper pipe. Inside the pipes there is a spring attached to the upper pipe which comes down to the lower pipe and is attached to a hammer with a foot pedal protruding to the outside; this serves as the hammering mechanism. On the lower end of the bottom pipe a threaded sleeve is inserted into which the elongated spike can be attached to. The spike is comprised not only of the spike, but also of two handles protruding from the sides of the upper portion of the spike and a bolt on the top so that the spike can be screwed into the sleeve on the bottom pipe of the stand. The two handles protruding from the sides of the head of the bolt on the upper portion of the spike serve two purposes. The first is for handles so the spike can turned or screwed into the sleeve in the bottom pipe of the stand. The second purpose is that the handles act as a guide when the spike is thrust into the ground; when the handles are resting on the surface of the ground, then the spike has reached the depth within the earth to securely anchor the stand to the ground. The third purpose is that the handles act as stabilizers so that when the spike is thrust all the way into the ground and the handles are resting upon the surface of the ground, then the stand cannot tilt or fall in case of wind or some other natural effect exerting its force upon the stand.

Once the spike is firmly screwed into the bottom pipe of the stand one can then thrust upon the foot pedal which is attached to a hammer with their foot. The foot pedal hammer and weight from the force exerted by ones foot will slide down the inside of the bottom hollow pipe comprising the stand and hammer upon the spike. Once the foot pedal hammer has reached the spike one can remove their foot from the foot pedal and the pedal and hammer will automatically slide back upward due to the spring which is attached to the hammer and the upper pipe of the stand; pulling the hammer back to its resting place in the bottom pipe of the stand. One can then place their foot again upon the foot pedal and continue the same routine until the spike is driven into the earth so that its handles are resting upon the surface of the ground.

Finally, we come to the third article of this invention which is the umbrella holder. The umbrella holder is comprised of two hollow pipes welded together at their ends with the upper pipe having a larger diameter than the lower pipe. The lower pipe of the umbrella holder will slide securely into the upper pipe of the stand with the upper pipe of the umbrella holder being wider than the upper pipe of the stand; thus acting as a stop. An umbrella post can then be lowered into the upper pipe of the umbrella holder securely holding the umbrella post and not allowing any tipping or falling. The upper pipe of the umbrella holder is made to fit most standard umbrella posts or can be used to fit any other means.

DETAILED DESCRIPTION OF THE INVENTION

Figure 1:
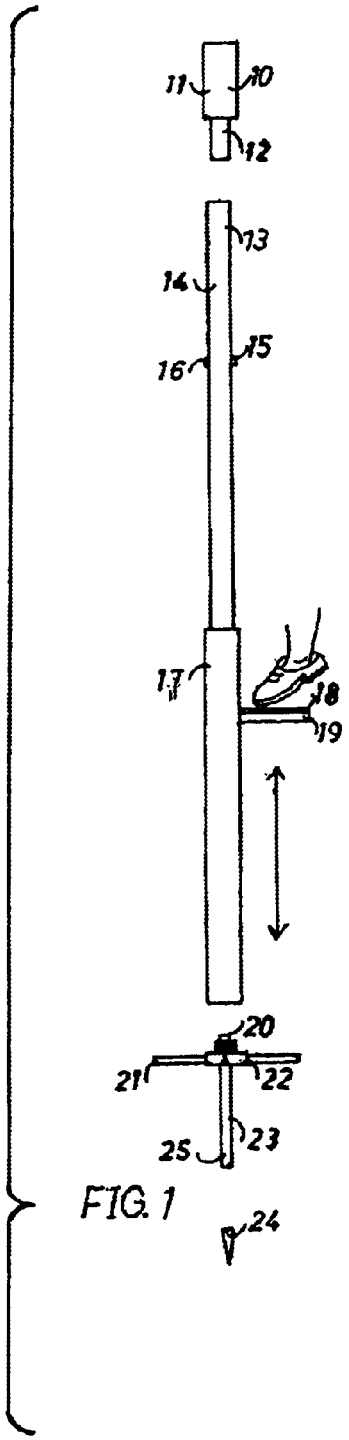
FIG. 1 is a side elevation view showing the umbrella holder, the stand, and the spike, and how the three pieces fit together with the umbrella holder sliding into place on the top portion of the stand and the spike which can be screwed into the bottom portion of the stand.

In giving reference to FIG. 1 a ground anchoring stand 14 is shown for a sunshade umbrella. In cases of wind or other natural occurrences an umbrella can act as a sail or parachute exerting tremendous force upon its stand causing it to tilt or even fall. This stand will prevent that from occurring because this stand is able to anchor itself firmly into the ground using a spike 25 which will be attached to the bottom portion of the stand 17 by being screwed into place on the bottom of 17. A foot pedal 18 attached to a hammer can be driven down onto the attached spike 25 using the force exerted by ones foot. An umbrella holder 11 can be slid into the top portion of the stand 13 to hold a sunshade umbrella. This stand once driven into the ground holding an umbrella will prevent an umbrella from tilting or falling from natural occurrences; such as wind.

The upper portion of the stand 13 is comprised of a steel pipe with an outside diameter of 1 3/16 inch. The bottom portion of 13 is welded securely to the upper portion of the bottom stand 17 and the upper portion 13 comprises a total length of 1 foot and 10 inches. The bottom portion 17 of the stand is also a steel pipe with an outside diameter of 1½ inch and has a length of 1 foot and 4¾ inches. The total length of the stand the upper steel pipe 13 combined with bottom steel pipe 17 is 3 feet and 2¾ inches. The length of the entire stand both 13 and 17 combined with the umbrella holder 11 and spike 25 attached will be 4 feet and 7 6/16 inches. The foot pedal 18 is situated 4¼ inches down from the upper area of the bottom pipe 19 of the stand. The foot pedal 18 is a flat piece of steel 3½ inches long, ¾ inch wide and 1/16 inch thick welded upon a steel rod 19 with a diameter of ½ inch for firm support.

The umbrella holder 11 is also comprised of two steel pipes welded together, the upper pipe 10 has an outside diameter of 1½ inch and a length of 4 inches. The bottom pipe 12 of the holder is a pipe with an outside recessed diameter of 1 inch (the original diameter was 1¼ inch) and a length of 2 inches welded to the bottom inside of the upper pipe 10 of the umbrella holder. The entire length of the umbrella holder with the upper pipe 10 combined with the bottom pipe 12 is 6 inches.

The spike 25 is comprised of several different pieces for it to function, the first is 22 which is a 1 inch steel bolt with an 8 pitch thread. The top portion of the bolt 20 has been resurfaced for impaction from the 18 foot pedal hammer. The head of the bolt 22 has the shape of a hexagon and there are steel rods 21 welded onto two of its sides. The steel rods 21 have a diameter of 5/16 inch and a length of 3 inches which serve two purposes. The first is for handles so that the spike 25 can be turned firmly into the bottom pipe 17 of the stand 14. The second purpose is that the handles 21 act as a guide when the spike 25 is thrust into the surface of the earth and the handles 21 are resting upon the ground, then the spike has reached the depth within the earth to firmly anchor the stand 14 to the ground. The third purpose is for the handles 21 to act as stabilizers to stabilize the stand 14 once anchored in the ground against wind or any other natural occurrence which could cause the stand 14 to tilt or fall. Welded on top of the head of the bolt 22 there is the hardened steel rod 23 which will serve as the tip 24 of the spike. The length of the rod 23 together with the tip 24 is 1 foot, having an upper portion 23 diameter of 6/16 inch. The tip 24 will began to angle in 11 inches down from the top of the rod 23 and come to a point.

Figure 2:
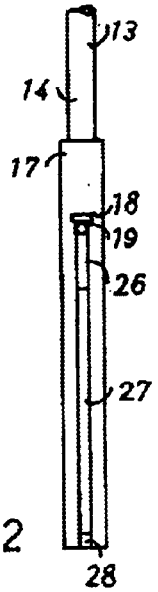
FIG. 2 mainly shows the bottom portion of the stand so that the foot pedal and the cut away in the stand in which the foot pedal slides up and down can be seen from the front.

In FIG. 2 the opening 27 in which the foot pedal 18 slides up and down with the attached weight 26 is shown. The upper pipe 13 of the stand 14 has been cut away because only the bottom pipe 17 of the stand 14 is to be used for explanations in FIG. 2. The bottom pipe 17 of the stand will have a 1 foot and ¾ inch long and ½ inch wide portion 27 cut out of it starting at the bottom of the pipe 17. This opening 27 is necessary to make the foot pedal 18 slide up and down. On the inside bottom 17 of the stand 14 there will be a steel threaded sleeve 28 inserted by means of welding with the thread having an 8 pitch to serve as a nut; so that the spike FIG. 1 and FIG. 4, 25 can be screwed into place on the bottom pipe FIG. 2, 17 of the stand 14. The bottom half of the hammer 26 which is attached to the foot pedal 18 will be visible through the opening 27. The hammer 26 is solid piece of steel with a diameter of 1¼ inch and a length of 4¾ inches which will make contact upon the resurfaced portion 20 of the bolt 22 attached to the spike 25 shown in FIG. 1 and FIG. 4, once the spike 25 is screwed into the sleeve 28 in the bottom pipe of the stand 17 in FIG. 2.

Figure 3:
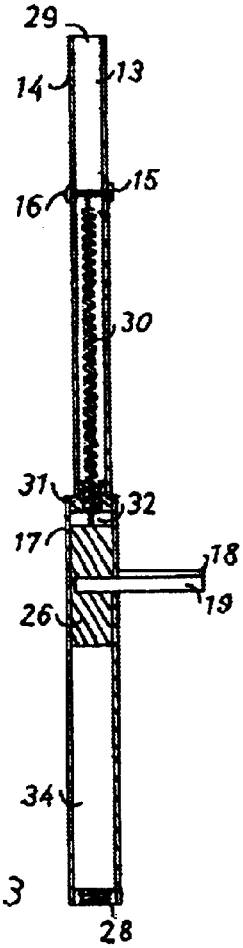
FIG. 3 is a sectional view of the stand so that the internal components of the stand can be viewed and how they make the stand operate.

A sectional view of the stand is given in FIG. 3 to the internal components and workings of the stand 14. The upper portion of the stand 13 has an inside diameter 29 of 1 inch and situated 7½ inches down from the top of the upper pipe 13 of the stand 14 is a steel bolt 16 which is a ¼ inch. The bolt 16 is tightened with a steel nut 15 which is also a ¼ inch. A soft steel spring 30 is attached to the bolt 16 and also to an eyebolt 32 which is attached to the hammer 26 which allows the hammer with the foot pedal 18 to slide back upwards after the hammer 26 has made contact with the spike 25 in FIG. 1 and FIG. 4. The spring 30 is a soft steel spring which has a measurement of 7/16 inch by 10¼ inches by 0.041 inch. The steel eyebolt 32 measures 3/16 inch and is attached to the hammer 26 by being screwed into the top by thread. The steel rod 19 upon which the foot pedal 18 is welded is inserted through the hammer 26 and is attached to the hammer 26 by means of welding; and the rod 19 has a length of 5¼ inches. In the top of the bottom pipe 17 of the stand 14 there is a hollow steel sleeve 31 inserted and attached by welding; upon which the upper pipe 13 of the stand 14 is welded to serve as a reinforcement and also to attach the upper pipe 13 of the stand 14 to the bottom pipe 17 of the stand 14. The bottom pipe 17 of the stand 14 has an inside diameter 34 of 1¼ inch.

Figure 4:
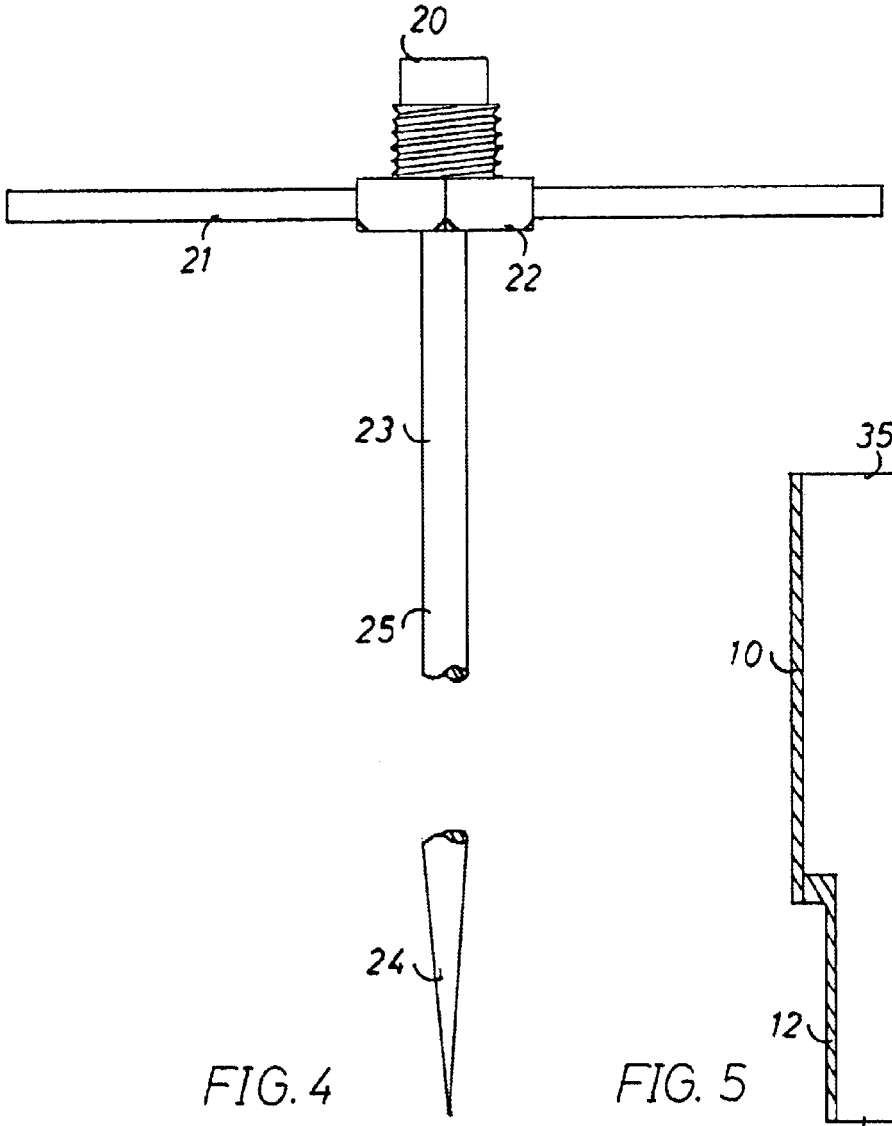
FIG. 4 is a side view of the spike in larger detail than the view given in FIG. 1.

A larger view of the spike 25 is given in FIG. 4, however, all the measurements have already been given for the spike 25 and all it components 24, 23, 22, 21, and 20 above and how they relate with the workings of the stand 14 shown in FIG. 1, FIG. 2, and FIG. 3.

Figure 5:
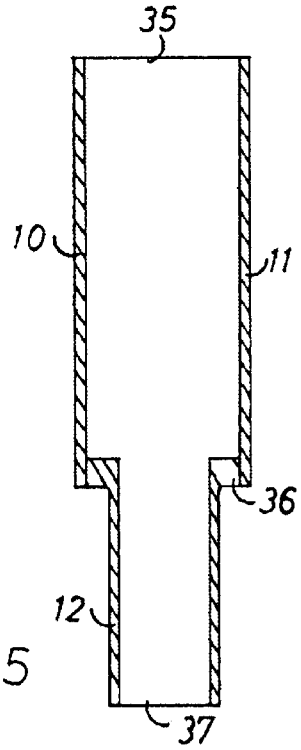
FIG. 5 is a sectional view of the umbrella holder so that it can viewed internally.

A sectional view of the umbrella holder 11 is given in FIG. 5 with the upper pipe 10 of the umbrella holder 11 having an inside diameter 35 of 1¼ inch. The bottom portion 12 has an inside diameter 37 of ¾ inch and is attached to the bottom 36 of the upper pipe 10 of the holder 11 by being press fitted.

The top 36 of the bottom pipe 12 of the holder was left to the original outside diameter of 1¼ inch and a length of ¼ inch to be press fitted into the bottom 36 of the upper pipe 10 of the holder 11. The rest of the bottom pipe 12 of the holder 11 has a length of 2 inches and an outside diameter of 1 inch which was recessed down from its original diameter of 1¼ inch giving the bottom pipe 12 of the holder 11 a total length of 2¼ inches.

I claim:

1. A sunshade umbrella stand which can be firmly locked into the surface of the earth comprising:

a hollow steel pole including a narrow upper portion and a wider lower portion relative to the upper portion, the lower portion of said hollow steel pole houses a biasing and slidable steel foot pedal hammer mechanism for longitudinal sliding a foot pedal along the lower portion of said hollow steel pole;

a umbrella holder including a small hollow steel pole having upper and lower portions such that the upper portion is wider than the lower portion, the lower portion of said umbrella holder is slidably mounted inside the top of said narrow upper portion of said hollow steel pole, the upper portion of said umbrella holder is adapted to receive an umbrella; and a spike including a hardened steel rod welded on top of the head of a steel bolt with steel rods protruding from the sides of the head of said bolt to be used for handles and guides, wherein said spike is screwed into the bottom of the lower portion of said hollow steel pole for anchoring the stand upon the surface of the earth.

2. A method for setting up a sunshade umbrella stand comprising the steps of attaching a hardened steel spike to a bottom portion of the umbrella stand, wherein the umbrella stand comprising an narrow upper steel pipe and a wide lower steel pipe, using spike steel rods protruding from the sides of the head of a steel bolt, screwing the steel bolt firmly into a threaded steel sleeve in the bottom portion of the umbrella stand, attaching the sunshade umbrella pole holder to the top of the umbrella stand by sliding downwardly a lower steel pipe of the sunshade umbrella pole holder into the upper steel pipe of the umbrella stand holding the sunshade umbrella pole holder firmly in place, and thrusting the umbrella stand into the surface of the earth by using a biasing and slidable steel foot pedal hammer making contact by longitudinal sliding upon an attached recessed portion of the steel spike; and forcing the steel spike to securely anchor itself within the earth.

3. A method for setting up the sunshade umbrella stand as defined in claim 2, penetrating the steel spike into the surface of the earth until the attached rods to the sides of the head of the bolt are resting upon the surface of the earth.

4. A method for setting up the sunshade umbrella stand as defined in claim 2, fitting the sunshade umbrella pole holder into the upper pipe of the umbrella stand such that the sunshade umbrella pole cannot tilt or fall and remaining in place therein.

* * * * *